US006494137B2

(12) United States Patent
Sawada et al.

(10) Patent No.: US 6,494,137 B2
(45) Date of Patent: Dec. 17, 2002

(54) SUPPORT FOR LITHOGRAPHIC PRINTING PLATE AND PRESENSITIZED PLATE

(75) Inventors: Hirokazu Sawada, Shizuoka (JP); Akio Uesugi, Shizuoka (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/897,455

(22) Filed: Jul. 3, 2001

(65) Prior Publication Data

US 2002/0029709 A1 Mar. 14, 2002

(30) Foreign Application Priority Data

Jul. 11, 2000 (JP) ..... 2000-209821

(51) Int. Cl.[7] ..... B41N 1/08; C22F 1/04; C22C 21/00

(52) U.S. Cl. ..... 101/459; 148/439; 420/532; 420/535; 420/544; 420/550; 428/650; 428/687

(58) Field of Search ..... 101/458, 459; 420/532, 534, 535, 538, 540, 541, 544, 547, 550, 551; 148/437–440; 428/141, 650, 653, 687; 430/278.1

(56) References Cited

U.S. PATENT DOCUMENTS 4,729,939 A * 3/1988 Nishikawa et al. ..... 420/544
4,902,353 A * 2/1990 Rooy et al. ..... 148/439
5,302,460 A * 4/1994 Pliefke et al. ..... 101/459
5,728,503 A * 3/1998 Dhillon et al. ..... 430/278.1
6,010,816 A * 1/2000 Nishio et al. ..... 420/540
6,324,978 B1 * 12/2001 Kaulen et al. ..... 101/459
6,337,136 B1 * 1/2002 Suzuki et al. ..... 101/459

FOREIGN PATENT DOCUMENTS

| | | | |
|---|---|---|---|
| EP | 978573 | * | 2/2000 |
| JP | 11-99763 A | | 4/1999 |
| JP | 11-99764 A | | 4/1999 |
| JP | 11-99765 A | | 4/1999 |
| JP | 11-115333 A | | 4/1999 |
| JP | 2000-37965 A | | 2/2000 |

* cited by examiner

*Primary Examiner*—Stephen R. Funk
(74) *Attorney, Agent, or Firm*—Burns, Doane, Swecker & Mathis, LLP

(57) ABSTRACT

A support for a lithographic printing plate obtained by performing surface graining and anodizing of an aluminum alloy plate, wherein the foregoing aluminum alloy plate contains specific contents of Fe, Si, Cu, Ti, Zn and Mg, with the balance being Al and incidental impurities. The presensitized plate obtained from this support for a lithographic printing plate is excellent in press life and in resistance to dot ink stain when processed into a lithographic printing plate. Preferably, the support for a lithographic printing plate, with regard to the surface of the support, has a center line average roughness $R_a$ in the range of 0.2–0.6 $\mu$m, a maximum height $R_{max}$ in the range of 3.0–6.0 $\mu$m, a ten-point mean roughness $R_z$ in the range of 2.0–5.5 $\mu$m, a center line peak height $R_p$ in the range of 1.0–3.0 $\mu$m, a center line valley depth $R_v$ in the range of 2.0–3.5 $\mu$m, a mean spacing $S_m$ in the range of 40–70 $\mu$m, an average inclination $\Delta a$ in the range of 6.0–12.0°, and a peak count $P_c$ in the range of 100–200.

4 Claims, No Drawings

SUPPORT FOR LITHOGRAPHIC PRINTING PLATE AND PRESENSITIZED PLATE

FIELD OF THE INVENTION

This invention relates to a support for a lithographic printing plate and a presensitized plate, particularly to a presensitized plate that can be processed into a lithographic printing plate having longer press life and higher resistance to dot ink stain and a support for a lithographic printing plate used for the presensitized plate.

BACKGROUND OF THE ART

Photosensitive lithographic printing plates using aluminum alloy plates as supports are extensively used in offset printing. Such lithographic printing plates are prepared by processing presensitized plates. Generally, the presensitized plate is made by graining the surface of an aluminum alloy plate, anodizing it, applying a photosensitive solution, and drying the applied coat to form a photosensitive layer. The presensitized plate is exposed imagewise, whereupon the exposed areas of the photosensitive layer change in physical properties. The photosensitive layer is then treated with a developer solution so that it is removed from the exposed areas (if the presensitized plate is positive-acting) or from the unexposed areas (if the presensitized plate is negative-acting). The areas from which the photosensitive layer has been removed are hydrophilic non-image areas and the areas where the photosensitive layer remains intact are ink-receptive image areas. Thus, presensitized plates are processed into lithographic printing plates using the changes in the physical properties of the photosensitive layer that take place upon exposure.

The lithographic printing plate is then mounted on the plate cylinder for printing. In printing, an ink and a fountain solution are supplied to the surface of the plate. The ink adheres only to the image areas of the plate and the image is transferred to the blanket cylinder, from which it is transferred to the substrate such as paper, thereby completing the printing process.

Aluminum alloy plates are conventionally grained by three known techniques, mechanical (e.g. ball graining and brush graining), electrochemical (electrolytic etching with a liquid electrolyte based on hydrochloric acid, nitric acid, etc.; this technique is also hereunder referred to as "electrolytic graining"), and chemical (etching with an acid or alkali solution). Since the plate surfaces prepared by electrolytic graining have homogeneous pits and exhibit better printing performance, it is common today. In order to produce further uniform grained surface, it is also common today to combine the electrolytic graining method with another method such as mechanical graining or chemical graining.

The nonuniformity of the roughened surfaces of supports for lithographic printing plates have considerable effects on press life and other parameters to the printing performance of lithographic printing plates. In order to deal with this problem, many proposals have been made that try to eliminate the nonuniformity. Particularly, in the electrochemical graining method, many proposals have been made try to produce uniform grained surface by changing the aluminum alloy composition of the plates and many proposals have also been made concerning the waveform and frequency of the power supply for electrolytic graining.

With a view to producing uniform grained surfaces on supports for lithographic printing plates, it has been proposed that streak occurrence be restrained and uniform graining by electrolytic etching be ensured by incorporating 0.05–0.1 wt % of Cu in an aluminum alloy support containing 0.05–1 wt % of Fe and 0.01–0.15 wt % of Si (JP-A-11-99763, the term "JP-A" as used herein means an "unexamined published Japanese patent application").

According to another proposal, it is described that the Fe, Si and Cu levels in an aluminum alloy plate are adjusted to the ranges of 0.05–1 wt %, 0.015–0.2 wt % and ≦0.001 wt %, respectively, with the distributed elemental Si level in the metal structure being regulated to 0.015 wt % or more and the uniformity in surface graining by electrolytic etching, fatigue strength and burning characteristics are improved (JP-A-11-99764).

According to yet another proposal, it is described that the Fe, Si and Cu levels in an aluminum alloy plate are adjusted to the ranges of 0.05–1 wt %, 0.015–0.2 wt % and 0.001–0.05 wt %, respectively, with the distributed elemental Si level in the metal structure being regulated to 0.015 wt % or more and no streaks occur and uniformity in surface graining by electrolytic etching, fatigue strength and better burning characteristics are improved (JP-A-11-99765).

According to a further proposal, it is described that the Fe, Si and Ti levels in an aluminum alloy plate are adjusted to 0.20–0.6 wt %, 0.03–0.15 wt % and 0.005–0.05 wt %, respectively, with part or all of these elements forming intermetallic compounds and the number of the grains of said intermetallic compounds present on the surface and of a size between 1 and 10 $\mu$m being regulated to 1000–8000 grains/mm$^2$ and pits can be formed by a short period of electrolytic graining treatment without producing unetched areas and uniform pits can be formed by graining treatment even if they are shallow (JP-A-11-115333).

However, if the Cu content of aluminum alloy supports is zero or very small (≦0.001 wt %) as proposed in JP-A-11-115333 and JP-A-11-99764, supra, no deep enough pits are generated and the supports have short press life and low ink stain resistance. Also problematic is the micro-streaking (unevenness in the form of very fine streaks) that results from low Cu levels.

Conversely, if aluminum alloy supports contain Cu in large amounts (≧0.05 wt %) as proposed in JP-A-11-99763, there is no problem of "micro-streaking" which occurs in the case of low Cu content but, on the other hand, no uniform electrolytic graining can be achieved and "yet-to-be etched", or undergrained, areas are prone to occur, leading particularly to poor ink stain resistance.

The aluminum alloy support proposed in JP-A-11-99765, supra has such a large content (≧0.015 wt %) of elemental Si (which is one of the forms in which Si occurs in aluminum alloy supports) that defects will readily develop in the anodized layer, leading to poor resistance to aggressive ink staining. The term "aggressive ink staining" will be explained later in detail and suffice it here to say that when printing is done with the occurrence of many interruptions, the non-image areas of the lithographic printing plate have so much increased ink receptivity on the surface that stain appears as spots or rings in the print (e.g. paper) and this stain is referred to as "aggressive ink staining".

The Assignee previously proposed that an aluminum alloy support containing 0.05–0.5 wt % of Fe, 0.03–0.15 wt % of Si, 0.006–0.03 wt % of Cu and 0.010–0.040 wt % of Ti, with at least one of 33 elements including Li, Na, K and Rb being contained in an amount of 1–100 ppm and with the purity of Al being regulated to 99.0 wt % or higher, should be subjected to graining treatments including electrolytic graining so as to produce a support for lithographic printing plates that has been grained with high efficiency to give a very high degree of uniformity in the grained surface (JP-A-2000-37965).

This is not a prior art, but the Assignee filed Japanese Patent Application No. 11-349888 and taught that when the aluminum alloy support disclosed in JP-A-2000-37965, namely, the one containing specified amounts of Fe, Si, Cu, Ti and at least one of 33 elements including Li, Na, K and Rb, was modified by further incorporating a very small amount of Mg, a surface of a support for a lithographic printing plate could be uniformly grained by electrochemical graining, and also filed Japanese Patent Application No. 2000-91197 wherein an aluminum alloy support exhibits improved resistance to aggressive ink stain of the foregoing support.

However, according to these supports, if particularly sharply inclined portions locally exist on the wavy surface of supports, and when these particularly sharply inclined portions are located within non-image areas of the lithographic printing plate, ink tends to be caught on these particularly sharply inclined portions upon printing, giving rise to a phenomenon so-called "dot ink stain" to locally stain the non-image areas with the ink. Additionally, although the supports described in JP-A-2000-37965 and in the specification of Japanese Patent Application No. 11-349888 are effective in producing uniform electrolytically grained surface, exhibiting an excellent press life when processed into a lithographic printing plate, it is nevertheless required, for the purpose of further improving the press life, to further increase the depth of pits to be generated through the electrolytic surface graining.

SUMMARY OF THE INVENTION

An object of the present invention is to provide a support for a lithographic printing plate, with improved resistance to dot ink stain, which was the defect of the conventional supports, and enhanced press life, while making it possible to retain the advantages of the aluminum alloy support for a lithographic printing plate containing, as essential ingredients, Fe, Si, Cu, Ti, Zn and Mg, and to provide a presensitized plate which makes use of this support.

As already mentioned, presensitized plates are a dual-layered structure comprising an aluminum alloy plate support having pits formed in its surface and which is overlaid with a photosensitive layer. After imagewise exposure of the plate surface, development is performed to make non-image areas from which the photosensitive layer has been removed and image areas where the photosensitive layer remains intact to record an image on the surface. For printing, ink and a fountain solution are supplied to the image-bearing lithographic printing plate, so that the fountain solution adheres to the non-image areas and the ink adheres to the image areas, from which it is transferred to the substrate such as paper via a blanket.

By the way, when the pits generated on the surface of the support through the electrolytic graining treatment are made deeper, the adhesion between the photosensitive layer and the support can be further increased, thereby making it possible to improve the press life. On the other hand, however, if a region where the pits are excessively deep is generated, a prominently sharply inclined portion tends to be generated on the wavy surface of the grained surface, and if this portion is located within a non-image area of the lithographic printing plate, ink tends to be caught in this portion upon printing, thus giving rise to a generation of local dot-like ink stain (i.e. dot ink stain).

Therefore, it is very important to delicately control the depth of the pits, and the control is executed by taking each of the following indices into consideration.

Water receptivity is a very important factor to influence various printing performances. Although the center line average roughness $R_a$ is effective as an index representing the magnitude of the water receptivity of the non-image areas (the capacity to hold a fountain solution on the surface of the non-image areas), $R_a$ is further known as being also effective as an index representing the magnitude of waviness of the wavy grained surface.

It is also effective to control the maximum height $R_{max}$ as an index to indicate there is no excessively deep portion, in combination with controlling the ten-point mean roughness $R_z$ as an index, differing from $R_{max}$, which excludes any influences by peculiarly concave portions or convex portions. Additionally, it is also effective to control the indices $R_p$ and $R_v$, which indicate the averages of the height of convex portion and depth of concave portion, respectively. In addition to these conditions mentioned above, the mean spacing $S_m$, the average inclination Δa and the peak count $P_c$ also should be in a specific range thereof so as to make it possible to obtain a further preferable result.

Here, $R_a$, $R_{max}$ and $R_z$ represent "center line average roughness," "maximum height" and "ten-point mean roughness," respectively, which are specified as an index of surface roughness in JIS (Japanese Industrial Standard) B0601-1982. $S_m$ represents "mean spacing of profile irregularities," which is specified as an index of surface roughness in JIS B0601-1994.

$R_p$ is a value representing a distance between the center line and a straight line parallel and also passing through the highest peak point within a portion where the measurement length L has been cut out from the roughness curve along the center line of the roughness curve. $R_v$ is a value representing a distance between the center line and a straight line parallel and also passing through the deepest valley or bottom point within a portion where the measurement length L has been cut out from the roughness curve along its center line. Δa is an average value of angles formed by the average line and the sectional curve within a portion where the measurement length L has been cut out from the roughness curve, and it can be determined by the following formula:

$$\Delta a = \frac{1}{L}\int_0^L \left|\frac{dy}{dx}\right| dx$$

(wherein L represents measurement length)

$P_c$ is a total number of counts that are counted within a portion where the measurement length L has been cut out from the roughness curve along its center line. In this portion, a straight line H at a consistent standard level in both positive and negative direction, parallel to the center line, was set, and it was considered one count when it went over the positive straight line after going over the negative straight line. Counting continued in this method until it reached the measurement length L.

The parameters employed to measure each of indices in the present invention are as follows:

$R_a$: Cut-off value 0.8 mm, Measurement length 4 mm;

$R_{max}$: Reference length 0.8 mm, Measurement length 4 mm;

$R_z$: Reference length 0.8 mm, Measurement length 4 mm;

$S_m$: Reference length 0.8 mm, Measurement length 4 mm;

$R_p$: Reference length 0.8 mm, Measurement length 4 mm;

$R_v$: Reference length 0.8 mm, Measurement length 4 mm;

$P_c$: Reference level 0.3 μm, Measurement length 6 mm, Cut-off value 0.8 mm.

The present inventor has found out that, taking each of the aforementioned indices into account, if aluminum alloy support for a lithographic printing plate containing, as essential ingredients, Fe, Si, Cu, Ti, Zn and Mg is electrolytically grained on the surface while specifying the content of Zn to the range of 0.002–0.02 wt % and the content of Mg to the range of 0.05–0.5 wt %, it is possible to form deep pits to not only further improve the press life with the foregoing aluminum alloy support when processed into a lithographic printing plate, but also to prevent the generation of a sharply inclined wavy surface of non-image areas of the lithographic printing plate, thus preventing the dot ink stain. In other words, it has been found out that by specifying the range of each of the indices in relation to surface roughness, it is made possible to obtain an aluminum alloy support containing, as essential ingredients, Fe, Si, Cu, Ti, Zn and Mg, exhibiting excellent properties when processed into a lithographic printing plate.

Therefore, the present invention provides a support for a lithographic printing plate which is obtained by performing surface graining treatment and anodizing treatment of an aluminum alloy plate, characterized in that, the said aluminum alloy plate contains 0.2–0.5 wt % of Fe, 0.04–0.11 wt % of Si, 0.003–0.04 wt % of Cu, 0.010–0.040 wt % of Ti, 0.002–0.02 wt % of Zn and 0.05–0.50 wt % of Mg, with the balance being Al and incidental impurities.

It is preferable in particular that the foregoing support for a lithographic printing plate, with regard to the surface of the support, satisfies at least one of the following conditions; a center line average roughness $R_a$ in the range of 0.2–0.6 μm, a maximum height $R_{max}$ in the range of 3.0–6.0 μm a ten-point mean roughness $R_z$ in the range of 2.0–5.5 μm, a center line peak height $R_p$ in the range of 1.0–3.0 μm, a center line valley depth $R_v$ in the range of 2.0–3.5 μm, a mean spacing $S_m$ in the range of 40–70 μm, an average inclination Δa in the range of 6.0–12.0°, and a peak count $P_c$ in the range of 100–200.

Preferably, the aforementioned surface graining treatment should be a combination of an electrochemical graining, and a mechanical graining and/or a chemical graining.

The present invention also provides a presensitized plate comprising the aforementioned support for a lithographic printing plate.

DETAILED DESCRIPTION OF THE INVENTION

The present invention is described below in detail.

The support for a lithographic printing plate according to the present invention uses an aluminum alloy. The aluminum alloy contains Al, Fe, Si, Cu, Ti, and Zn as the essential ingredients.

Iron (Fe) has the ability to enhance the mechanical strength of the aluminum alloy. If the Fe content is less than 0.2 wt %, the mechanical strength of the aluminum alloy is so low that the lithographic printing plate prepared by processing the support is mostly likely to break when it is mounted on the plate cylinder of the press.

If the Fe content exceeds 0.5 wt %, the strength of the aluminum alloy becomes higher than necessary and the lithographic printing plate prepared by processing the support has such poor fitting properties that after being mounted on the plate cylinder of the press, the plate may readily break during printing. If the support strength is a predominant factor, the Fe content is preferably adjusted to lie between 0.2 and 0.4 wt %. If the lithographic printing plate is intended for use in press proofing, the limitations about strength and fitting properties are not necessarily critical and the ranges set forth above may be slightly varied.

Silicon (Si) as it occurs in the aluminum alloy either dissolves in Al or forms precipitates of Al—Fe—Si intermetallic compounds or Si alone. The Si dissolved in Al has dual functions, one of providing a uniform electrochemically grained surface and the other of establishing uniformity in the electrolytic graining pits, chiefly in their depth. Si is contained as an incidental impurity in the base Al metal which is the starting material for the support and, in certain cases, the Si content is already at least 0.03 wt %. Therefore, Si levels less than 0.03 wt % are not practically feasible and in order to prevent variations from one lot of the starting material to another, intentional addition of Si is often made in very small amounts. If the Si content is less than 0.04 wt %, not only the above-mentioned dual functions of Si are unattainable but it is also necessary to prepare a high-purity and, hence, costly base Al metal; such low Si levels are therefore practically infeasible. If the Si content exceeds 0.11 wt %, the plate prepared by processing the support has only poor resistance to aggressive ink staining during printing. Therefore, the Si content should lie within the range of 0.04 0.11 wt %, preferably 0.05–0.10 wt %.

Copper (Cu) is a very important element for controlled electrolytic graining and contributes to improving the uniformity of electrolytic graining pits, chiefly the uniformity of their diameter. This is due to the ability of Cu to increase the diameter of electrolytic graining pits. Uniformity in pits is essential for better printability. If the Cu content is less than 0.003 wt %, the surface oxide layer in which pits are to be formed electrochemically may have such a low electric resistance that the formation of uniform pits is sometimes impossible. Conversely, if the Cu content exceeds 0.04 wt %, the surface oxide layer in which pits are to be formed electrochemically has such a high electric resistance that coarse pits are prone to form. Therefore, the Cu content should lie within the range of 0.003–0.04 wt %, preferably 0.01–0.02 wt %.

Titanium (Ti) is conventionally contained in order to refine the crystal structure of the aluminum alloy as it is cast. If the Ti content exceeds 0.040 wt %, the surface oxide layer may have such a low electric resistance during electrolytic graining that the formation of uniform pits is sometimes impossible. Conversely, if the Ti content is less than 0.010 wt %, the crystal structure of the aluminum alloy being cast may not be sufficiently refined that even after it is finished to a thickness of 0.1–0.5 mm through various steps, the vestigial coarse crystal structure remaining after the casting operation may occasionally cause significant deterioration in appearance. Therefore, the Ti content should lie within the range of 0.010–0.040 wt %, preferably 0.020–0.030 wt %. Titanium (Ti) is added as an Al—Ti alloy or an Al—B—Ti alloy.

Zinc (Zn) is an important element for controlled electrolytic graining and contributes to restraining the occurrence of coarse pits. The Zn content should lie within the range of 0.002–0.02 wt %, preferably 0.003–0.01 wt %. The present inventor has found out that particularly deeper pits can be generated by incorporating Zn in an aluminum alloy plate containing Mg and Cu.

Magnesium (Mg) has dual functions, one of refining the recrystallized structure of Al and the other of improving various mechanical strength characteristics such as tensile strength, yield, fatigue strength, flexural strength and resistance to heat softening. Mg helps achieve uniform pit distribution during electrolytic graining, so it is also an important ingredient that contributes to providing a uniform grained surface.

The distribution of pits may deteriorate if the Mg content is less than 0.05 wt % and the same problem may occur if the Mg content exceeds 0.5 wt %. Therefore, the Mg content should lie within the range of 0.05–0.50 wt %, preferably 0.08–0.50 wt %, more preferably 0.10–0.40 wt %.

The aluminum alloys to be used in the present invention preferably have an Al content (Al purity) of at least 99.0 wt %, more preferably at least 99.4 wt %.

In the present invention, the content of incidental impurities can be calculated by subtracting the Al content and the above-specified contents of the essential alloy ingredients from the total of 100%.

The mechanical strength of aluminum alloys depends on their Al purity and usually, low Al purity results in less flexible aluminum alloys. Therefore, if the Al content in the aluminum alloys to be used in the invention is lower than the range specified above, problems may sometimes occur when they are processed into lithographic printing plates as typified by poor mountability on the press.

In order to work the aluminum alloys into plates, the following method can typically be employed. First, a melt of aluminum alloy adjusted to have specified contents of alloy ingredients is purified and cast by conventional methods. In the purification step, hydrogen, other unwanted gases and solid impurities in the melt are removed. The examples of purification process to remove the unwanted gases are fluxing process and degassing process using argon gas, chloride gas or the like. The examples of purification process to remove the solid impurities are filtering process using-a so-called "rigid" media filter such as a ceramic tube filter or a ceramic foam filter, a filter using alumina flakes, alumina balls or some other filtering media, glass cloth filter or the like. Alternatively, the purification process can be applied by the combination of degassing process and filtering process.

In the next step, the molten aluminum alloy is cast by using either a fixed mold as in DC molding or a driven mold as in continuous casting. In the case of DC molding, ingots 300–800 mm thick are produced and a surface layer is removed by scalping by a thickness of 1–30 mm, preferably 1–10 mm. If necessary, soaking is subsequently performed. If soaking is to be done, heat is applied at 450–620° C. for 1–48 hours in order to prevent coarsening of intermetallic compounds. If the application of heat lasts for less than an hour, only insufficient soaking may occur.

Thereafter, the aluminum alloy plate is subjected to cold rolling and hot rolling. It is suitable to start hot rolling at 350–500° C. Intermediate annealing may be performed either before or after or during cold rolling. If intermediate annealing is to be performed, heat may be applied in a batchwise annealing furnace at 280–600° C. for 2–20 hours, preferably at 350–500° C. for 2–10 hours, or in a continuous annealing furnace at 400–600° C. for no more than 6 minutes, preferably at 450–550° C. for no more than 2 minutes. A finer crystal structure may be produced by heating at a rate of 10° C./sec or more in a continuous annealing furnace. The aluminum alloy plate finished to a predetermined thickness, say, 0.1–0.5 mm may be straightened by a roller leveler, a tension leveler or the like to have a higher degree of flatness. It is common practice to pass the plate through a slitter line so that it is worked to a predetermined plate width.

The aluminum alloy plate is then subjected to a surface graining treatment to be made into a support for a lithographic printing plate. As mentioned above, the aluminum alloy plate used in the present invention is suited for an electrochemical graining, enabling a grained surface having fine pits to be easily formed, and thus is suited for producing a lithographic printing plate with excellent printing property. The electrochemical graining is performed in aqueous solution mainly consisting of nitric acid or aqueous solution mainly consisting of hydrochloric acid by employing direct current or alternating current. The aluminum alloy plate used in the present invention is also suited for a combination of an electrochemical graining, and a mechanical graining and/or a chemical graining.

It is possible, through the electrochemical graining, to generate crater-shaped or honeycomb-shaped pits having an average diameter of 0.5–20 $\mu$m on the surface of the aluminum alloy plate at an area ratio of 30–100%. Such pits are capable of improving the stain resistance of non-image areas of printing plate and the press life thereof. Furthermore, it is possible, through the foregoing treatment, to form at the same time a wavy grained surface where the center line average roughness $R_a$ is in the range of 0.2–0.6 $\mu$m.

However, if a sharply inclined portion is locally generated, it will cause a generation of dot ink stain. More specifically, the dot ink stain tends to be generated if the maximum height $R_{max}$ exceeds 6.0 $\mu$m, the ten-point mean roughness $R_z$ exceeds 5.5 $\mu$m or the center line valley depth $R_v$ exceeds 3.5 $\mu$m, and therefore it is preferable to restrict the $R_{max}$ to the range of 3.0–6.0 $\mu$m, the $R_z$ to the range of 2.0–5.5 $\mu$m, and the $R_v$ to the range of 2.0–3.5 $\mu$m.

Furthermore, if the center line peak height $R_p$ is in the range of 1.0–3.0 $\mu$m, the mean spacing $S_m$ is in the range of 40–70 $\mu$m, the average inclination $\Delta a$ is in the range of 6.0–12.0°, and the peak count $P_c$ is in the range of 100–200, the depth, size and shape of the peak can be further in uniformity, thereby eliminating the local sharply inclined portion, and thus, it results in a preferable situation where the press life can be improved, and at the same time, the generation of dot ink stain can be effectively inhibited, when processed into a lithographic printing plate.

In the electrochemical graining, quantity of electricity necessary for forming sufficient pits, namely the product of the electric current and the duration of current-carrying becomes an important requirement. It is preferable in view of saving energy if it is possible to form sufficient pits with less electricity. There are no particular limitations to other conditions.

The mechanical graining is suited for forming a wavy grained surface of 0.2–1.0 $\mu$m in $R_a$ on the surface of an aluminum alloy plate. In the present invention, the grained surface is formed with a center line average roughness $R_a$ preferably in the range of 0.2–0.6 $\mu$m, and more preferably, in the range of 0.3–0.4 $\mu$m. Although the mechanical graining is able to form a wavy surface more effectively than the foregoing electrochemical graining, the mechanical graining may not be adopted to make the Ra smaller. Although there are no particular limitations with regard to the mechanical graining in the present invention, it is for example performed as described in JP-B-50-40047 (the term "JP-B" as used herein means an "examined Japanese patent publication"). Further, there are no particular limitations with regard to the chemical graining also, and it can be performed in the publicly known manner, thereby forming waviness and pits of the same features as those formed through the mechanical graining.

Subsequent to the graining step, the aluminum alloy plate is anodized so that its surface has increased wear resistance. Any electrolyte can be used in anodization as long as it can form a porous oxide film. Generally, sulfuric acid, phosphoric acid, oxalic acid, chromic acid or mixtures thereof are used. The concentration of the electrolyte is determined as appropriate for various factors including its kind. The conditions for anodization defy generalization since they vary considerably with the electrolyte used but the following may be given as guide figures: electrolyte concentration, 1–80 wt %; electrolyte temperature, 5–70° C.; current density, 1–60 $A/dm^2$; voltage, 1–100 V; electrolysis time, 10–300 seconds.

In order to provide higher stain resistance during printing, the electrolytically grained and rinsed aluminum alloy plate may be etched lightly with an alkali solution and rinsed. In order to remove any alkali-insoluble matter (smut) that remains on its surface, the plate may be desmutted with an acid such as sulfuric acid and rinsed before dc electrolysis is performed in sulfuric acid to form an anodized layer. If necessary, the anodized surface may be rendered hydrophilic with a suitable agent such as a silicate.

The support for a lithographic printing plate of the present invention provided by these procedures is excellent in uniformity of graind surface or pits, and therefore exhibits excellent printing performance when processed into a lithographic printing plate.

In order to process the support for the lithographic printing plate of the present invention into a presensitized plate, sensitizers can be applied to its surface and dried to form the photosensitive layer. The sensitizers that can be used are in no way limited and any types may be applied that are commonly used on presensitized plates. The thus presensitized plate is exposed imagewise with a lith film and subsequently developed and gummed to prepare lith plate that can be mounted on the press. If the applied photosensitive layer has high enough sensitivity, direct imagewise exposure can be accomplished with a laser.

Any sensitizers may be employed as long as they change solubility or swellability in liquid developers upon exposure. Typical examples of sensitizers are listed below. (A) Photosensitive layer composed of o-quinone diazide Compounds Positive-acting photosensitive compounds include o-quinone diazide compounds typified by o-naphthoquinone diazide compounds. A preferred o-naphthoquinone diazide compound is described in JP-B-43-28403 and it is the ester of 1,2-diazonaphthoquinone-sulfonic acid chloride and a pyrogallol-acetone resin. Also preferred is the ester of 1,2-diazonaphthoquinonesulfonic acid chloride and a phenol-formaldehyde resin which is described in U.S. Pat. No. 3,046,120 and 3,188,210. Other known kinds of o-naphthoquinonediazide compounds are also useful.

Particularly preferred o-naphthoquinonediazide compounds are those obtained by reacting polyhydroxy compounds of no more than 1,000 in molecular weight with 1,2-diazonaphthoquinonesulfonic acid chloride. Preferably, the polyhydroxy compound is reacted with 0.2–1.2 equivalent amounts, more preferably 0.3–1.0 equivalent amount, of 1,2-diazonaphthoquinonesulfonic acid chloride assuming that the hydroxy groups in the polyhydroxy compound are in one equivalent amount. A preferred 1,2-diazonaphthoquinonsulfonic acid chloride is 1,2-diazonaphthoquinone-5-sulfonic acid chloride although 1,2-diazonaphthoquinone-4-sulfonic acid chloride is also useful.

The o-naphthoquinonediazide compounds are mixtures in which the 1,2-diazonaphthoquinonesulfonic acid chloride has substituents introduced in different positions and amounts. Preferably, the content of the complete ester in the mixture (i.e., the proportion of the mixture that is assumed by a compound in which all hydroxy groups present have been converted to the 1,2-diazonaphthoquinonesulfonic acid ester) is at least 5 mol %, more preferably between 20 and 90 mol %, most preferably between 20 and 99 mol %.

Instead of the o-naphthoquinonediazide compounds, polymers having o-nitrocarbinol ester groups as described in JP-B-56-2696 may be used as positive-acting photosensitive compounds. Also useful are systems in which compounds that generate acids upon photodegradation are combined with compounds having acid-dissociable —C—O—C— or —C—O—Si— groups. For example, a compound that generates an acid upon photodegradation may be combined with acetal or O,N-acetal compound (JP-A-48-89003), an orthoester or an amide acetal compound (JP-A-51-120714), a polymer having acetal or ketal groups in the backbone chain (JP-A-53-133429), an enolether compound (JP-A-55-12995), an N-acyliminocarbon compound (JP-A-55-126236), a polymer having ortho-ester groups in the backbone chain (JP-A-56-17345), a silyl ester compound (JP-A-60-10247), or a silylether compound (JP-A-60-37549 and JP-A-60-121446).

The positive-acting photosensitive compound (which may be in the combination system described above) preferably assumes 10–50 wt %, more preferably 15–40 wt %, of the photosensitive composition in the photosensitive layer.

The photosensitive layer may solely be composed of o-quinonediazide compounds but the latter are preferably used together with binder resins that are soluble in aqueous alkalis. Binder resins that are soluble in aqueous alkalis include: cresol-formaldehyde resins such as novolaks, phenol-formaldehyde resins, m-cresol-formaldehyde resins, p-cresol-formaldehyde resins, m-/p-mixed cresol-formaldehyde resins and phenol/cresol mixed (which may be m-, p- or m-/p-mixed)-formaldehyde resins; phenol modified xylene resins; polyhydroxystyrene and polyhalogenated hydroxystyrene; acrylic resins having phenolic hydroxy groups as disclosed in JP-A-51-34711; acrylic resins having sulfonamido groups as described in JP-A-2-866; and urethane-base resins. The binder resins that are soluble in aqueous alkalis preferably have weight average molecular weights of 500–20,000 and number average molecular weights of 200–60,000.

The binder resins that are soluble in aqueous alkalis are contained in such amounts that they assume no more than 70% of the total mass of the photosensitive composition. As described in U.S. Pat. No. 4,123,279, resins such as t-butyl phenol-formaldehyde resin and octyl phenol-formaldehyde resin that are obtained by polycondensation of formaldehyde and phenol having a $C_{3-8}$ alkyl group as a substituent may be used with the binder resins soluble in aqueous alkalis and this is preferred for the purpose of improving the ink receptivity of the image areas.

The photosensitive composition may further contain various substances such as sensitivity enhancing cyclic acid anhydrides, print-out agents for providing visible image right after exposure, dyes as image colorants, and other fillers. Exemplary cyclic acid anhydrides that can be used are described in U.S. Pat. No. 4,115,128 and include phthalic anhydride, tetrahydrophthalic anhydride, hexahydrophthalic anhydride, 3,6-endoxy-$\Delta^4$-tetrahydrophthalic anhydride, tetrachlorophthalic anhydride, maleic anhydride, chloromaleic anhydride, α-phenylmaleic anhydride, succinic anhydride and pyromellitic anhydride. Sensitivity can be enhanced by a factor of up to about 3 by incorporating the cyclic acid anhydrides in amounts of 1–15% of the total mass of the photosensitive composition. The print-out agent for providing visible image right after exposure may be exemplified by a system in which a photosensitive compound that releases an acid upon exposure is combined with a salt-forming organic dye.

Specific examples include the combination of o-naphthoquinone-diazide-4-sulfonic acid halogenides with salt-forming organic dyes that is described in JP-A-50-36209 and JP-A-53-8128, as well as the combination of trihalomethyl compounds with salt-forming organic dyes that is described in JP-A-53-36233, JP-A-54-74728, JP-A-60-3626, JP-A-61-143748, JP-A-61-151644 and JP-A-63-58440. Not only these salt-forming organic dyes but also other dyes can be used as image colorants. Suitable dyes including the salt-forming organic dyes are oil-soluble dyes and basic dyes.

Specific examples include Oil Yellow #101, Oil Yellow #103, Oil Pink #312, Oil Green BG, Oil Blue BOS, Oil Blue #603, Oil Black BY, Oil Black BS and Oil Black T-505 (all being the products of Orient Chemical Industry Co., Ltd.), Victoria Pure Blue, Crystal Violet (CI 42555), Methyl Violet (CI 42535), Rhodamine B (CI 45170B), Malachite Green (CI 42000) and Methylene Blue (CI 52015). The dyes described in JP-A-62-293247 are particularly preferred.

The photosensitive composition is applied to the support as dissolved in a suitable solvent that dissolves the ingredients described above. Exemplary solvents include ethylene dichloride, cyclohexanone, methyl ethyl ketone, ethylene glycol monomethyl ether, ethylene glycol monoethyl ether, 2-methoxyethyl acetate, 1-methoxy-2-propanol, 1-methoxy-2-propyl acetate, toluene, methyl acetate, ethyl acetate, methyl lactate, ethyl lactate, dimethyl sulfoxide, dimethylacetamide, dimethylformamide, water, N-methylpyrrolidone, tetrahydrofurfuryl alcohol, acetone, diacetone alcohol, methanol, ethanol, isopropanol, diethylene glycol and dimethyl ether. These solvents may be used in admixture.

When in solution, the above-mentioned ingredients (as the solids content) assume 2–50 wt %. The coating weight varies with the use and generally ranges from 0.5 to 3.0 $g/m_2$ in terms of the solids content. As the coating weight decreases, higher sensitivity to light is attained but, on the other hand, the physical properties of the photosensitive layer deteriorate.

In order to provide better applicability, the photosensitive composition incorporates surfactants such as fluorine-base surfactants of the types described in JP-A-62-170950. The content of the surfactants preferably ranges from 0.01 to 1%, more preferably from 0.05 to 0.5%, of the total mass of the photosensitive composition. (B) Photosensitive layer composed of diazo resin and binder Negative-acting photosensitive diazo compounds that can suitably be used in the present invention are so-called "photosensitive diazo resins" which are the product of condensation between formaldehyde and a diphenylamine-p-diazonium salt which is the product of reaction between a diazonium salt and an organic condensing agent such as aldol or acetal that has a reactive carbonyl group (see U.S. Pat. Nos. 2,063,631 and 2,667,415).

Other useful condensed diazo compounds are described in JP-B-49-480001, JP-B-49-45322, JP-B-49-45323, etc. This type of photosensitive diazo compounds are usually obtained in the form of water-soluble inorganic salts and can, hence, be applied as aqueous solution. If desired, water-soluble diazo compounds may be reacted with aromatic or aliphatic compounds having at least one phenolic hydroxy group or sulfonyl group or both a phenolic hydroxy group and a sulfonyl group in accordance with the method described in JP-B-47-1167 and the resulting substantially insoluble photosensitive diazo resin is subsequently used.

The diazo resins are preferably contained in the photosensitive layer in amounts of 5–50 wt %. A smaller content of the diazo resins naturally leads to higher sensitivity to light but, on the other hand, the storage stability of the photosensitive layer decreases. An optimum content of the diazo resins is approximately between 8 and 20 wt %. While various polymers can be used as a binder, preferred are those which have functional groups such as hydroxy, amino, carboxy, amido, sulfonamido, active methylene, thioalcohol and epoxy groups.

Specific examples of such polymers include: the shellac described in BP 1,350,521; the polymers described in BP 1,460,978 and U.S. Pat. No. 4,123,276 which contain hydroxyethyl (meth)acrylate units as primary repeating units; the polyamide resins described in U.S. Pat. No. 3,751,257; the phenol resins described in BP 1,074,392; poly(vinyl acetal) resins such as poly(vinyl formal) resin and poly(vinyl butyral) resin; the linear polyurethane resins described in U.S. Pat. No. 3,660,097; phthalated poly(vinyl alcohol) resins; epoxy resins prepared from bisphenol A and epichlorohydrin; polymers having amino groups such as polyaminostyrenes and polyalkylamino(meth)acrylates; and cellulose derivatives such as cellulose acetate, cellulose alkyl ethers and cellulose acetate phthalates.

The composition composed of the diazo resins and binders may further contain additives such as pH indicators of the types described in BP 1,041,463, the phosphoric acid and dyes described in U.S. Pat. No. 3,236,646.

The photosensitive layer preferably has a thickness of 0.1–30 $\mu$m, more preferably 0.5–10 $\mu$m. The amount (solids content) of the photosensitive layer to be provided on the support is typically within the range of from about 0.1 to about 7 $g/m^2$, preferably from 0.5 to 4 $g/m^2$.

The presensitized plate thus processed from the support for the lithographic printing plate of the present invention is then subjected to imagewise exposure and subsequent treatments including development in the usual manner, whereupon a resin image is formed to prepare a lithographic printing plate.

Consider, for example, a positive-acting presensitized plate having the photosensitive layer (A). After imagewise exposure, development is effected with aqueous alkali solutions of the types described in U.S. Pat. No. 4,259,434 and JP-A-3-90388, whereupon the exposed areas of the presensitized plate are freed of the photosensitive layer to prepare a lithographic printing plate.

Consider next a negative-acting presensitized plate having the photosensitive layer (B) composed of a diazo resin and a binder. After imagewise exposure, the plate is treated with a liquid developer of the type described in U.S. Pat. No. 4,186,006, whereupon the unexposed areas of the plate are freed of the photosensitive layer to prepare a lithographic printing plate. In the case of the negative-acting presensitized plate described in JP-A-5-2273 or JP-A-4-219759, development may be done by treatment with an aqueous solution of an alkali metal silicate as described in those patents, whereby a lithographic printing plate is prepared.

EXAMPLES

The present invention will be further explained in details with reference to the following various examples, which are not intended to limit the present invention.

1. Producing Supports for Lithographic Printing Plates (Examples 1–7 and Comparative Examples 1–5)

The aluminum alloy plates, each having compositions formulated as shown in Table 1, were subjected to various treatments under the following conditions to thereby obtain supports for lithographic printing plates, with each index (characteristics) as shown in Table 2.

The aluminum alloy plates were subjected to an alkali etching treatment (quantity of dissolved Al: 5.5 g/m$^2$), followed by rinsing, followed by a desmutting treatment (nitric acid spray) and then rinsing, followed by an electrolytic graining (quantity of electricity: 270 C/dm$^2$) in a solution containing 9.5 g/L of nitric acid and 5 g/L of aluminum nitrate by employing an alternating current. Then, rinsing, followed by an alkali etching treatment (quantity of dissolved Al: 0.4 g/m$^2$), followed by rinsing, followed by a desmutting treatment (sulfuric acid spray) and finally anodizing (quantity of anodized layer: 2.5 g/m$^2$) was performed.

2. Preparing Presensitized Plates

The supports for the lithographic printing plates prepared in Examples and Comparative Examples were coated with sensitizer composition A (for its recipe, see below) to give a dry coating weight of 2.5 g/m$^2$ and subsequently dried to prepare presensitized plates.

<Sensitizer Composition A>

| | |
|---|---|
| The product of esterification between naphthoquinone-1,2-diazido-5-sulfonyl chloride and pyrogallol-acetone resin (as described in Example 1 in U.S. Pat. No. 4,186,006) | 0.75 g |
| Cresol novolak resin | 2.00 g |
| Oleyl Blue #603 (product of Orient Chemical Industry Co., Ltd.) | 0.04 g |
| Ethylene dichloride | 16 g |
| 2-Methoxyethyl acetate | 12 g |

3. Development and Printing

Each of the presensitized plates was fixed in a vacuum printing frame, exposed for 50 seconds to a 3 kW metal halide lamp at a distance of 1 m through a transparent positive film and developed with a 5.26 wt % aqueous sodium silicate solution ($SiO_2/Na_2O$=1.74 in molar ratio; pH, 12.7) to prepare a lithographic printing plate. After the development, the plates were thoroughly washed with water and gummed before printing was done in the usual manner.

4. Evaluating Press Life and Resistance to Dot Ink Stain

Each of the prepared lithographic printing plates was evaluated for press life and resistance to dot ink stain by the following methods.

(1) Press Life

The number of impressions that could be made before the solid image areas of each plate were found "blurred" by visual inspection was counted and the result was evaluated. The results were evaluated in relative values, with the value for Comparative Example 1 taken as 100.

(2) Resistance to Dot Ink Stain

During the printing for the purpose of evaluating the aforementioned press life, small dot-like stain in the non-image areas was examined after 15,000 sheets were printed. The meaning of each symbol shown in Table 1 is as follows.

⊙: absolutely none

○: none

○Δ: almost none

Δ: a few

ΔX: some

X: many

5. Evaluation of the Surface Features of Supports for Lithographic Printing Plates To evaluate the surface features of each support for lithographic printing plate, with regard to the surface of each presensitized plate with photosensitive layer removed by a solvent, $R_a$, $R_{max}$, $R_z$, $R_p$, $R_v$, $S_m$, Δa and $P_c$ were measured by a surface roughness meter ("Surfcom", model type E-MD-575B; Tokyo Seimitsu, Co., Ltd.). The results are shown in Table 2.

It will be seen from Table 1 that the presensitized plates according to the present invention obtained from the supports for lithographic printing plates of the present invention using aluminum alloy plate each containing of specific content of specific elements were excellent in press life and also in resistance to dot ink stain when they were processed into a lithographic printing plate (Examples 1–7). This can be attributed to the facts that the supports for lithographic printing plates of the present invention were provided on the surface thereof with a uniform and dense distribution of deep pits and that the grained surfaces thereof were in uniformity.

On the other hand, in the case of Comparative Example 1, although the pits on the surface of the support were excellent in uniformity, the depth thereof was too shallow to obtain a satisfactory press life. In the cases of Comparative Examples 4 and 5, the pits on the surface of the support were not in uniformity, allowing large, hollow-shaped pits to be locally existed, thereby deteriorating the press life and also the resistance to dot ink stain. In the cases of Comparative Examples 2 and 3, since the content of Cu in the aluminum alloy plate was inappropriate though the contents of Mg and Zn therein were appropriate, the uniformity of pits on the surface of the support was not bad and the press life thereof was good, but dot ink stains were found due to the local existence of large, hollow-shaped pits.

TABLE 1

| | Alloy ingredients (wt %) | | | | | | Press | Resistance to dot ink |
|---|---|---|---|---|---|---|---|---|
| | Si | Fe | Cu | Mg | Zn | Ti | life | stain |
| Example 1 | 0.06 | 0.3 | 0.017 | 0.05 | 0.003 | 0.03 | 130 | ⊙ |
| Example 2 | 0.06 | 0.3 | 0.017 | 0.10 | 0.003 | 0.03 | 135 | ⊙ |
| Example 3 | 0.06 | 0.3 | 0.017 | 0.20 | 0.003 | 0.03 | 140 | ⊙ |
| Example 4 | 0.06 | 0.3 | 0.017 | 0.40 | 0.003 | 0.03 | 150 | ⊙ |
| Example 5 | 0.06 | 0.3 | 0.017 | 0.50 | 0.003 | 0.03 | 150 | ○ |
| Example 6 | 0.06 | 0.3 | 0.017 | 0.20 | 0.010 | 0.03 | 145 | ⊙ |
| Example 7 | 0.06 | 0.3 | 0.017 | 0.20 | 0.020 | 0.03 | 145 | ⊙ |
| Comparative Example 1 | 0.06 | 0.3 | 0.017 | 0.001 | 0.001 | 0.03 | 100 | ○ |
| Comparative Example 2 | 0.06 | 0.3 | 0.05 | 0.20 | 0.020 | 0.03 | 145 | ΔX |
| Comparative Example 3 | 0.06 | 0.3 | 0.001 | 0.20 | 0.020 | 0.03 | 130 | ΔX |
| Comparative Example 4 | 0.06 | 0.3 | 0.05 | 0.001 | 0.001 | 0.03 | 90 | X |
| Comparative Example 5 | 0.06 | 0.3 | 0.001 | 0.001 | 0.001 | 0.03 | 80 | X |

TABLE 2

| | $R_a$ (μm) | $R_{max}$ (μm) | $R_z$ (μm) | $R_p$ (μm) | $R_v$ (μm) | $S_m$ (μm) | Δa (°) | $P_c$ (μm) |
|---|---|---|---|---|---|---|---|---|
| Example 1 | 0.32 | 3.0 | 2.3 | 1.1 | 2.1 | 40 | 6.2 | 150 |
| Example 2 | 0.34 | 3.3 | 2.6 | 1.2 | 2.1 | 48 | 6.5 | 145 |
| Example 3 | 0.36 | 3.5 | 3.0 | 1.3 | 2.3 | 62 | 7.4 | 130 |
| Example 4 | 0.38 | 3.8 | 3.5 | 1.4 | 2.4 | 70 | 8.5 | 120 |
| Example 5 | 0.4 | 4.0 | 3.5 | 1.5 | 2.5 | 70 | 9 | 100 |
| Example 6 | 0.36 | 3.5 | 3.0 | 1.2 | 2.1 | 52 | 7.2 | 135 |
| Example 7 | 0.36 | 3.5 | 3.0 | 1.2 | 2.1 | 45 | 7 | 140 |
| Comparative Example 1 | 0.27 | 3.0 | 2.0 | 1.1 | 1.8 | 40 | 5.8 | 130 |

TABLE 2-continued

| | $R_a$ (μm) | $R_{max}$ (μm) | $R_z$ (μm) | $R_p$ (μm) | $R_v$ (μm) | $S_m$ (μm) | Δa (°) | $P_c$ (μm) |
|---|---|---|---|---|---|---|---|---|
| Comparative Example 2 | 0.45 | 5.8 | 4.9 | 2.8 | 3.4 | 75 | 12 | 90 |
| Comparative Example 3 | 0.41 | 5.3 | 4.5 | 1.6 | 3.3 | 80 | 10 | 120 |
| Comparative Example 4 | 0.65 | 6.5 | 5.8 | 3.3 | 3.7 | 75 | 13 | 80 |
| Comparative Example 5 | 0.59 | 6.3 | 5.8 | 1.5 | 3.6 | 80 | 12.5 | 110 |

[Advantageous Effect of the Invention]

The support for a lithographic printing plate of the present invention is excellent in press life when processed into a lithographic printing plate since the pits thereof are in uniformity and deep. Also, It is possible to prevent the generation of dot ink stain when processed into a lithographic printing plate, due to the absence of local existence of large, hollow-shaped pits.

What is claimed is:

1. A support for a lithographic printing plate which is obtained by performing surface graining treatment and anodizing treatment of an aluminum alloy plate, characterized in that, the said aluminum alloy plate contains 0.2–0.5 wt % of Fe, 0.04–0.11 wt % of Si, 0.003–0.04 wt % of Cu, 0.010–0.040 wt % of Ti, 0.002–0.02 wt % of Zn and 0.05–0.50 wt % of Mg, with the balance being Al and incidental impurities.

2. The support for a lithographic printing plate according to claim 1, characterized in that, with regard to the surface of the support, a center line average roughness $R_a$ is in the range of 0.2–0.6 μm, a maximum height $R_{max}$ is in the range of 3.0–6.0 μm, a ten-point mean roughness $R_z$ is in the range of 2.0–5.5 μm, a center line peak height $R_p$ is in the range of 1.0–3.0 μm, a center line valley depth $R_v$ is in the range of 2.0–3.5 μm, a mean spacing $S_m$ is in the range of 40–70 μm, an average inclination Δa is in the range of 6.0–12.0°, and a peak count $P_c$ is in the range of 100–200.

3. A presensitized plate comprising the support for a lithographic printing plate according to claim 2 and a photosensitive layer thereof.

4. A presensitized plate comprising the support for a lithographic printing plate according to claim 1 and a photosensitive layer thereof.

* * * * *